United States Patent [19]

Aatinen

[11] 4,065,842

[45] Jan. 3, 1978

[54] ROLLS AND ROLL-MANUFACTURING METHODS

[75] Inventor: Eino Aatinen, Jyvaskyla, Finland

[73] Assignee: Valmet Oy, Finland

[21] Appl. No.: 783,449

[22] Filed: Mar. 31, 1977

Related U.S. Application Data

[63] Continuation-in-part of Ser. No. 620,229, Oct. 6, 1975.

[30] Foreign Application Priority Data

Apr. 2, 1976 Finland ..... 760904

[51] Int. Cl.[2] ..... A47J 43/28; F16G 11/00

[52] U.S. Cl. ..... 29/148.4 D; 29/121.4

[58] Field of Search ..... 29/148.4 D, 121 H, 121.4

[56] References Cited

U.S. PATENT DOCUMENTS

| | | | |
|---|---|---|---|
| 3,633,259 | 1/1972 | Nikanen | 29/148.4 D |
| 3,718,959 | 3/1973 | Sailas | 29/121 H |

*Primary Examiner*—C.W. Lanham
*Assistant Examiner*—V. K. Rising
*Attorney, Agent, or Firm*—Steinberg & Blake

[57] ABSTRACT

A roll, of the type used in paper machines, is manufactured by rotating an inner roll body around its axis while simultaneously winding onto the outer surface of the inner roll body an elongated metal strip the convolutions of which press against each other so as to cover the outer surface of the inner roll body at the area of this outer surface onto which the strip is wound. This strip has an inner edge surface engaging the outer surface of the inner roll body, an outer edge surface distant therefrom, and opposed side surfaces extending between the inner and outer edge surfaces. At each of the wound convolutions of the strip the opposed side surfaces thereof respectively engage, over their entire areas, the adjoining side surfaces of adjoining strip convolutions over the entire areas of these adjoining side surfaces. At any instant during the winding of the strip onto the inner drum body, the strip has an end convolution an inner side surface of which presses against the immediately preceding convolution and an outer side surface of which is exposed at one end of the series of convolutions which have already been wound. A compressive force, which is directed parallel to the axis of the inner roll body, is applied against the outer side surface of this end convolution, during winding of the strip onto the inner roll body, at a location extending inwardly from the outer edge surface of this end convolution along the outer side surface thereof toward but terminating short of the inner roll body. The magnitude of this compressive force is sufficiently great to deform and elongate the end convolution at the location thereof to which the compressive force is applied.

10 Claims, 3 Drawing Figures

ROLLS AND ROLL-MANUFACTURING METHODS

CROSS REFERENCE TO RELATED APPLICATION

This application is a continuation-in-part of copending application Ser. No. 620,229, filed Oct. 6, 1975.

BACKGROUND OF THE INVENTION

The present invention relates to rolls, of the type which are used in paper machines, and in particular to a method of manufacturing such rolls.

In order to manufacture a grooved roll of the type used in a paper machine, it is known to wind onto the exterior surface of an inner roll body an elongated metal strip the profile of which is such that the strip has at an outer edge region a thickness less at an inner edge region which engages the inner roll body, so that as a result when such a strip is wound onto the inner roll body the resulting roll will have at its exterior an elongated helical groove. Thus, such grooved rolls are known, the suitably profiled strip which is wound onto the inner roll body being made of steel. In this connection reference may be made to U.S. Pat. No. 3,718,959.

Many rolls, of the type used in paper machines, require a smooth exterior surface which should be resistant to corrosion and/or wear and tear. Conventionally, such a smooth covering is made from pieces of appropriate sheet material which are welded onto an inner roll body. The covering provided in this way is subsequently machined so as to have its ultimate desired dimensions and condiguration. Such a manufacturing procedure, however, is cumbersome and always involves a considerable undesirable waste of material.

SUMMARY OF THE INVENTION

It is a primary object of the present invention to provide a roll and roll-manufacturing method according to which the above drawbacks are avoided.

Thus, it is an object of the present invention to provide a method for manufacturing a roll of the above type which has a substantially smooth exterior surface which may be non-grooved.

Another object of the present invention is to extend principles disclosed in the above copending application to use in the manufacture of rolls which need not have an exterior helical groove.

In particular, it is an object of the present invention to provide a roll of the above type with a relatively smooth exterior surface in such a way that a strip which is wound onto an inner roll body will not have any tendency to have convolutions of the strip tilt away from other convolutions, with all of the convolutions of such a strip pressing tightly against each other to achieve a substantially smooth exterior surface for such a roll.

It is an object of the present invention to provide a method of the above type according to which the finish-machining of the exterior surface of the completed roll can take place during the time when a strip is wound onto an inner roll body.

Also it is an object of the present invention to provide a roll of the above type which will have desired properties in accordance with a suitable selection of the material for a strip which is wound onto an inner roll body.

While reference is made below to a smooth-surfaced covering for a roll, it is to be understood that such a smooth-surface covering may include relatively shallow grooves, blind holes, etc.

According to the method of the invention, an inner roll body is rotated about its axis while an elongated metal strip is wound onto an exterior surface of the inner roll body with the convolutions of the wound strip pressing against each other and engaging the outer surface of the roll body so as to cover the lateral outer surface at the area thereof onto which the strip is wound. The strip has an inner edge surface engaging the outer surface of the inner roll body, an outer edge surface distant therefrom, and a pair of opposed side surfaces extending between the inner and outer edge surfaces. The opposed side surfaces of each convolution engage over their entire areas the side surfaces of adjoining convolutions over the entire areas of the latter. At any instant during the winding of the strip onto the inner roll body, the strip has an end convolution an inner side surface of which engages an adjoining side surface of the immediately preceding convolution and the outer side surface of which is exposed at one end of the series of convolutions which have already been wound. A compressive force is applied against this outer side surface of the end convolution at a location extending inwardly from the outer edge surface thereof toward but terminating short of the outer surface of the inner drum body. This compressive force is parallel to the axis of the inner roll body so that the end convolution is pressed by this compressive force against the immediately preceding convolution. The magnitude of this compressive force is such that it is capable of deforming and elongating the end convolution at the location of its outer side surface to which this compressive force is applied.

BRIEF DESCRIPTION OF DRAWINGS

The invention is illustrated by way of example in the accompanying drawings which form part of this application and in which.

DESCRIPTION OF THE PREFERRED EMBODIMENTS

Figure 1:
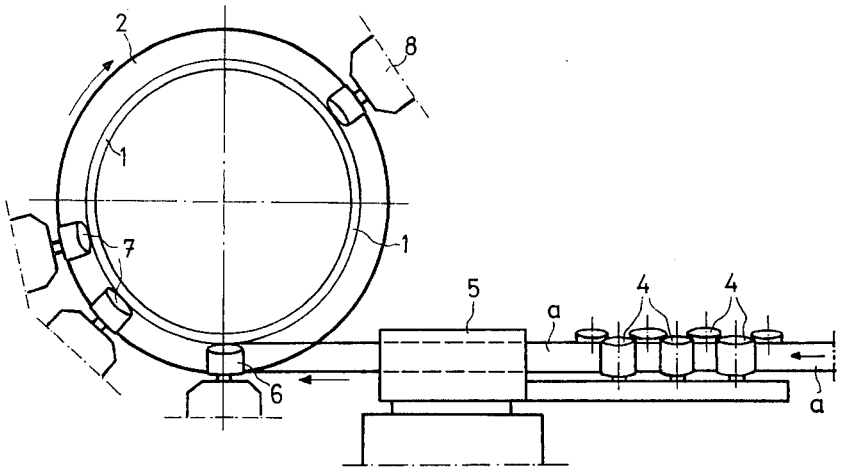
FIG. 1 is a schematic elevation illustrating one possible method according to the invention.

Referring now to the drawings, FIG. 1 schematically illustrates an inner roll body 1 which is rotated about its axis while an elongated metal strip *a* is wound onto the inner roll body 1 at an outer surface thereof. The inner roll body 1 may be fixed by way of journal pins at the ends thereof in a lathe, for example, by means of which the inner roll body 1 is rotated about its axis. The roll body 1 will turn in a clockwise direction, as indicated by the arrow at the upper left part of FIG. 1.

The lathe or the equivalent thereof has a conventional carriage which is guided for movement in a direction parallel to the axis about which the roll body turns, and this carriage is fed automatically in synchronism with the rotation of the body 1 in a well known manner. The carriage carries structure for straightening, braking, deforming and supporting the strip *a* which is wound onto the body 1 at the exterior surface thereof, the feed of the carriage being such that the convolutions of the strip *a* will be situated tightly against each other. Thus, of the above structures, FIG. 1 illustrates the straightening rollers 4 and the brake means 5, which are carried by the carriage, the strip *a* being guided through the brake means 5 where a friction plate, for example, presses against the strip *a* so as to create in the strip *a* a suitable tension as it is wound onto the rotating roll body 1. Thus, during such winding of the strip *a* onto the roll body 1, the latter will be covered at its outer surface at the area onto which the strip *a* is wound.

The carriage also carries a guide roller 6 which guides the strip *a* onto the roll body 1 into engagement with the immediately preceding convolution of the strip *a* which has been wound onto the roll body 1. Thus, the guide roller 6 has its axis extending radially with respect to the axis of the body 1. This guide roller 6 engages the strip *a* where it extends tangentially with respect to the outer surface of the roll body 1 and just starts to bend and engage the outer surface of the roll body 1.

As the strip turns beyond the guide roller 6, to the left thereof as viewed in FIG. 1, it comes into engagement with one or more deforming rollers 7 which also may be carried by the carriage of the lathe and which press with a powerful compressive force against the outer side surface of the strip *a*, this outer side surface being visible in FIG. 1. Thus, at any given instant during winding of the strip *a* onto the outer surface of the roll body 1, the strip *a* will have an exposed outer end surface 2 which is shown in FIG. 1, the opposed inner side surface of the strip *a* at the end convolution thereof which at any given instant is wound onto the body 1 pressing against the immediately preceding convolution so that the end convolution which is visible in FIG. 1 and which has the exposed outer side surface 2 is situated at the end of the series of convolutions which have already been wound onto the body 1. The carriage carries a suitable hydraulic pressure unit, such as a suitable piston and cylinder assembly, for example, cooperating with each roller 7 to apply a powerful compressive force against the exposed outer side surface 2 of the end convolution of the strip *a*, this compressive force acting in a direction parallel to the axis of the roll body 1 and having a magnitude which is sufficiently great to deform and elongate the end convolution at the part of the outer side surface 2 thereof which is engaged by a roller 7. As a result of this action of the compression rollers 7, the axes of which also extend radially with respect to the axis of the roller body 1, the strip *a* readily curves to the curvature required by the outer surface of the inner roll body 1, effectively engaging this outer surface of the roll body 1 over the entire area thereof onto which the strip *a* is wound, with this elongation and deformation also causing the convolution of the strip *a* to tend to tilt toward the immediately preceding convolution, thus opposing any tendency of a convolution to tilt in the opposite direction undesirably away from the immediately preceding convolution.

Figure 2:
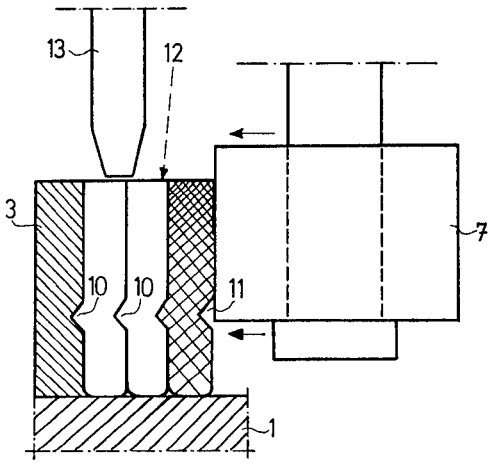
FIG. 2 is a schematic partly sectional view of a series of convolutions, FIG. 2 illustrating the manner in which a compressive force is applied as well as how machining of the exterior surface of the finished roll takes place.

As is most clearly apparent from FIG. 2, each compression roller 7 engages the end convolution of the strip *a* at a part thereof which extends inwardly from an outer edge surface of the strip *a* toward the roll body 1 but terminates short of the latter so that the compressive force is applied to the strip *a* at a location which is spaced outwardly beyond the part of the strip *a* which directly engages the outer surface of the roll body 1. The deforming and stretching or elongating of the outer part of the strip *a* is indicated for the end convolution of FIG. 2 by way of the hatching thereof which it will be noted is denser toward the outer edge surface of the end convolution which at any given instant is being wound onto the roll body 1. As a result of this feature the outer region of the strip *a* will be elongated to an extent greater than the opposed inner edge surface thereof which directly engages the exterior surface of the roll body 1 with the result that not only does the strip *a* readily curve to the curvature of the outer surface of the roll body 1 but also it tends to tilt or bend slightly toward the immediately preceding convolution, thus contributing in this way to a minimizing of the risk that any convolution will tilt away from the immediately preceding convolution.

While FIG. 1 shows two compression rollers 7, depending upon the particular requirements there may be only one or more than two such rollers. The hydraulic units which respectively cooperate with the rollers 7 to urge the latter against the exposed outer side surface of the end convolution are not illustrated.

FIG. 1 also shows a guide roller 8 which is supported by the carriage and which assures that the part of the winding which has already been completed will not become loose or spread undesirably in the direction of the axis of the inner roll body 1.

The brake means 5 are utilized so as to brake the strip *a* in such a way that a suitable degree of tensile stress is maintained in the strip *a*, thus assuring the tautness of the winding. This brake means 5 also may advantageously include members capable of measuring and controlling the braking force.

As is indicated schematically in FIG. 2, prior to the winding of the strip *a* onto the roller body 1, there is attached to the latter, at one end region thereof, for example, a ring 3. Thus the ring 3 may, for example, be welded directly to the body 1. Then a free end of the strip *a* is fixed to the ring 3 at the right side surface thereof, as viewed in FIG. 2. For example the free end of the strip *a* may be welded to the ring 3. With the end of the strip *a* thus fixed to the ring 3, the winding operations are started and progress as described above and shown in FIGS. 1 and 2.

Figure 3:
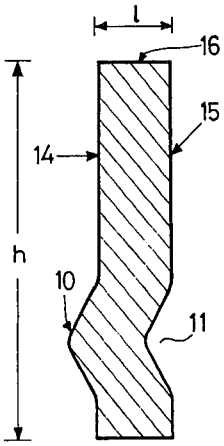
FIG. 3 is a sectional illustration of a strip of the invention indicating in particular dimensional relationships and the configuration of the cross section of the strip.

FIGS. 2 and 3 illustrate the cross section of the strip *a*. Thus, the radial dimension *h* of the strip *a* between its outer edge surface 16 and its opposed inner edge surface which directly engages the outer surface of the body 1 is several times greater than the thickness *l* of the strip *a*, this thickness being equal to the distance between the opposed side surfaces 14 and 15 of the strip *a*.

The strip *a* may be made of a material which is suitable for the requirements of the roller which is to be manufactured. For example, the strip *a* may be made of stainless steel. Before the winding thereof it is already preworked so as to have a proper profile or cross-sectional configuration. In the illustrated example this profile is such that one of the side surfaces, namely surface 14, is formed with an elongated bulge 10 extending longitudinally of the strip, while the opposed side surface 15 is formed with a matching groove 11. As a result of this arrangement, the side surface 15 of any convolution will receive the bulge 10 of the next convolution in the groove 11 of the side surface, so that in this way the bulges and grooves cooperate in the manner indicated in FIG. 2. This construction assures a prevention of unwinding of the wound strip even if for any reason it should rupture during use of the roll manufactured according to the invention.

As is apparent from FIG. 3, the cross section of the strip *a* is substantially rectangular at least at its outer region against which the compression roller 7 is pressed. It will be noted that in the illustrated example, as shown in FIG. 2, the compressive force is applied outwardly from the groove 11 to the outer edge surface 16. Thus, disregarding the bulge 10 and groove 11, the strip *a* is of a substantially rectangular cross section, although the thickness, if desired, may taper slightly, so that the cross section may also be slightly trapezoidal.

It will be seen that with the above-described method of the invention, each convolution of the strip *a* engages at its side surfaces 14 and 15, over the entire areas thereof, the adjoining side surfaces of the adjoining convolutions also over the entire areas of these adjoining side surfaces. As a result, the outer edge surface 16 of any one convolution is flush with the forms an extension of the outer edge surfaces of the adjoining convolutions, and since this surface 16 is smooth, the winding of the strip *a* onto the inner roll body 1 in accordance with the invention will provide the roll body 1 with an exterior smooth surface free of any grooves in the illustrated example. For some purposes, however, slight grooves may be desirable, and in this case the outer edge surface 16 may be slightly concave so that a slight depression is formed therein between the edges where the surfaces 14 and 15 intersect the outer edge surface 16, or small blind bores may extend into the strip *a* from its outer surface 16 through a relatively short distance. Constructions of this latter type are also considered as forming a smooth surface for the roll body. Thus, it is possible to provide the finished roll with a smooth surface 12 which is indicated in FIG. 2, and desired properties can be provided in accordance with the choice of material of the strip *a*, such as suitable corrosion-resisting characteristics by properly selecting the material of the strip *a*.

Inasmuch as the outer surface of the inner roll body 1 is previously machined in a highly accurate manner so as to be finished with precise dimensions, and inasmuch as the strip *a* is very precisely manufactured, it is possible by way of the method of the invention to obtain for the completed roll an exterior surface 12 which not only is smooth but which also has closely and precisely determined dimensions.

Moreover, with the method of the invention it is possible to carry out the final finish-machining of the surface 12 while the strip *a* is wound onto the body 1. This finish-machining step is schematically indicated in FIG. 2 by way of a roll 13 which is fragmentarily illustrated and which has an outer surface engaging the surface 12 so as to provide the latter with a predetermined finish as desired.

The method of the invention for covering the roll body 1 with the wound strip *a* may be completed in any suitable way. For example after the roller 7 are displaced away from the final convolution, a second ring 3 is placed on the body 1 and welded to the latter as well as to the final convolution. Of course such a ring 3 will be pressed with a compressive force against this final convolution so that when such a ring 3 is welded to the body 1 and to the final convolution, all of the convolutions will be maintained tightly pressing against each other.

It is thus apparent that with the method of the invention waste of expensive profile strip material will be reduced to a minimum and in addition the roll is manufactured quickly and inexpensively without sacrificing precision or high quality.

Of course, the invention includes not only the method referred to above and shown in the drawings but also the roll which is manufactured by this method.

What is claimed is:

1. In a method for manufacturing a roll, particularly of the type used in paper machines, the steps of rotating an inner roll body around its axis, simultaneously winding onto an outer surface of the inner roll body an elongated metal strip in a manner forming from said strip on said outer surface of said inner roll body a plurality of successive convolutions pressing against each other and covering said outer surface of said inner roll body at the area of said other surface where said strip is wound thereon, with said strip having an inner edge surface engaging said outer surface of said inner roll body, an outer edge surface distant from said inner roll body, and opposed side surfaces which extend between said inner and outer edge surfaces and which at each convolution engage over their entire areas the side surfaces of adjoining convolutions over the entire areas of the latter side surfaces, said strip having at any instant during the winding thereof onto said inner drum body an end convolution which has an inner side surface engaging an adjoining side surface of the immediately preceding convolution and an outer side surface which is exposed at one end of the series of convolutions which have already been wound, and applying to said exposed outer side surface of said strip, during the winding thereof onto said inner drum body, at a location extending from said outer edge surface of said end convolution inwardly toward but terminating short of said outer surface of said inner drum body, a compressive force acting in the direction of the axis of said drum body and pressing said end convolution against the immediately preceding convolution with said compressive force having a magnitude sufficiently great to deform and elongate said end convolution at a region thereof spaced from said inner drum body where said force is applied to said end convolution.

2. In a method as recited in claim 1 and wherein at least one roller whose axis extends radially with respect to the axis of said inner drum body is pressed against said end convolution at said location of said outer side surface thereof for applying said force thereto.

3. In a method as recited in claim 1 and wherein said strip has a substantially rectangular cross section at least at one outer region of said strip to which said compressive force is applied.

4. In a method as recited in claim 1 and wherein said strip is formed on one of its side surfaces with an elongated bulge extending longitudinally of said strip and at the other of its side surfaces with an elongated groove matching said bulge, so that each convolution has its elongated bulge received in a groove of one adjoining convolution and its elongated groove receiving a bulge of the other adjoining convolution.

5. In a method as recited in claim 4 and wherein said groove is situated at the outer side surface of each convolution and said compressive force is applied to the part of said outer side surface of the end convolution which extends from said groove to the outer edge surface of the end convolution.

6. In a method as recited in claim 1 and wherein said strip has between its inner and outer edge surfaces a radial dimension which is several times greater than the thickness of the strip between its opposed side surfaces.

7. In a method as recited in claim 1 and wherein said strip is made of a corrosion-resistant material for providing said inner roll body with a corrosion-resistant covering.

8. In a method as recited in claim 1 and wherein the outer edge surface of each convolution is flush with and forms an extension of the outer edge surface of adjoining convolutions, and all of said outer edge surfaces of all of said convolutions providing the roll with a substantially smooth outer surface.

9. In a method as recited in claim 1 and including the step of finish-machining the outer edge surfaces of said convolutions during winding of said strip onto said inner roll body.

10. A roll manufactured by the method of claim 1.

* * * * *